United States Patent [19]

Bodig et al.

[11] 4,268,888

[45] May 19, 1981

[54] APPARATUS FOR GENERATING ENGINE SPEED-DEPENDENT IGNITION CONTROL SIGNALS

[75] Inventors: Bernd Bodig, Leinfelden-Echterdingen; Werner Jundt, Ludwigsburg, both of Fed. Rep. of Germany

[73] Assignee: Robert Bosch GmbH, Stuttgart, Fed. Rep. of Germany

[21] Appl. No.: 66,862

[22] Filed: Aug. 15, 1979

[30] Foreign Application Priority Data

Oct. 3, 1978 [DE] Fed. Rep. of Germany ..... 2842998

[51] Int. Cl.[3] ..... F02B 5/02

[52] U.S. Cl. ..... 361/236; 361/239; 123/414; 123/418

[58] Field of Search ..... 361/236, 239; 123/414, 123/415, 418, 617, 618, 612, 146.5 A

[56] References Cited

U.S. PATENT DOCUMENTS

| | | | |
|---|---|---|---|
| 4,063,539 | 12/1977 | Gorille et al. | 123/418 X |
| 4,095,576 | 6/1978 | Hattori et al. | 123/414 X |
| 4,138,982 | 2/1979 | Hattori et al. | 123/415 |
| 4,164,926 | 8/1979 | Kindlman | 123/415 |
| 4,174,697 | 11/1979 | Podrapsky et al. | 123/418 |
| 4,178,892 | 12/1979 | Podrapsky et al. | 123/418 |
| 4,188,929 | 2/1980 | Podrapsky et al. | 123/414 |
| 4,201,163 | 5/1980 | Hattori et al. | 123/415 |

*Primary Examiner*—J. D. Miller
*Assistant Examiner*—L. C. Schroeder
*Attorney, Agent, or Firm*—Frishauf, Holtz, Goodman & Woodward

[57] ABSTRACT

In order to prevent ignition power losses at low engine speeds and further to provide for the use of ignition control signals of both unipolar and bipolar nature, the invention provides that a Schmitt trigger which generates the principal ignition control signal is actuated by the transducer. The switching thresholds of this Schmitt trigger are changeable by a secondary threshold recognition circuit which can shift at least the negative threshold of the principal threshold circuit to more positive values. The invention also includes a delay circuit which prevents the return of the shifted threshold to more negative values. Still further included is a third threshold circuit which is engaged only at some higher engine speed.

7 Claims, 5 Drawing Figures

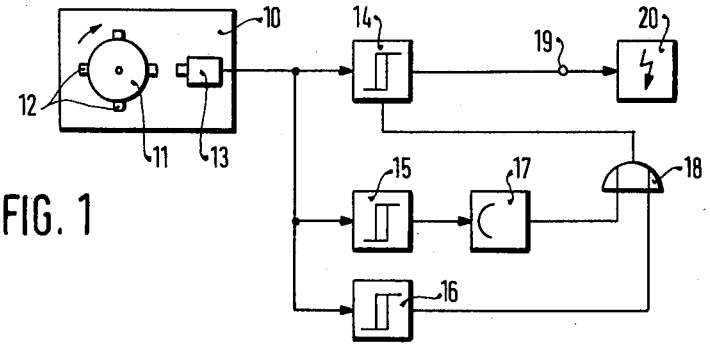
FIG. 1
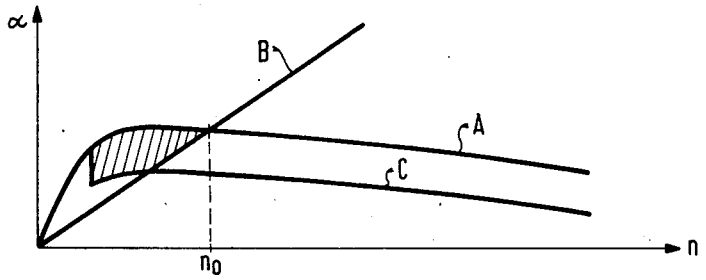
FIG. 2
FIG. 3
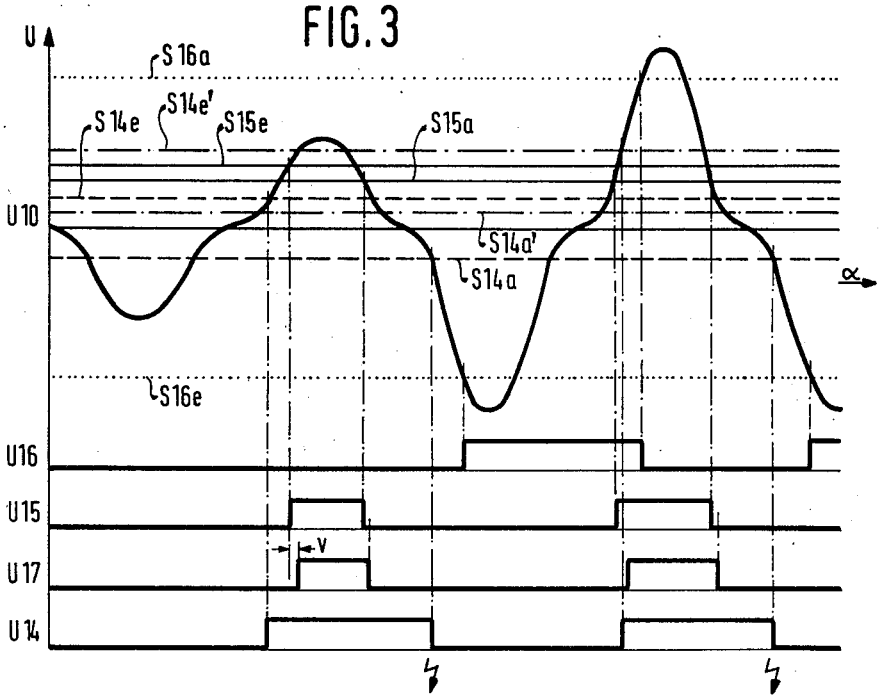

APPARATUS FOR GENERATING ENGINE SPEED-DEPENDENT IGNITION CONTROL SIGNALS

CROSS REFERENCE TO RELATED PUBLICATIONS AND APPLICATIONS

U.S. Pat. application Ser. No. 734,745, filed Oct. 22, 1976, JUNDT et al., published as German AS No. 2 549 586; U.S. Pat. application Ser. No. 869,627, filed Jan. 16, 1978, Bodig et al., published as German OS No. 2 701 968.

FIELD OF THE INVENTION

The invention relates to the control of ignition signals for internal combustion engines. More particularly, the invention relates to ignition systems which include a control system that regulates the ignition primary switch closure angle and further includes a rotating signal generator that generates an rpm-dependent output signal which is processed by the control circuit.

BACKGROUND AND PRIOR ART

Ignition systems of the above-described type are known, for example, from the German Auslegeschrift No. 2 549 586, corresponding to U.S. Pat. application Ser. No. 734,745. In the ignition system described there, the control signal, i.e., the ignition output switch closure signal, is increased abruptly at a given engine speed. Each ignition process requires a certain amount of energy to be stored in the ignition coil of the system which in turn implies that the time during which current flows through the coil should remain constant for all engine speeds. However, the control signal from an rpm-dependent sensor changes in the sense of decreasing the time of current flow for increasing rpm. In the known system, an attempt is made to compensate for this effect by the abrupt increase of the sensor signal beginning with a certain engine speed, thereby changing the trigger threshold for the sensor voltage.

Another system known from the German laid-open application No. 2 701 968, corresponding to U.S. Pat. application Ser. No. 869,627, continuously increases the ignition closure signal so as to attempt to maintain the ignition closure time constant for varying engine speeds.

The aforementioned known systems are not generally suitable for all sensors because some sensors, for example inductive sensors, generate signals which include negative and positive half-waves. In such a case the triggering thresholds of the subsequent threshold recognition circuits are so constructed as to be set in a first condition when the positive threshold is exceeded and then to be reset or placed in a second condition when the negative threshold is exceeded. However, some other sensors, for example Hall-effect sensors, generate unipolar output signals. Such signals are not suitable for addressing a threshold recognition circuit which is intended for a bipolar transducer because the second threshold is never activated.

Still another disadvantage of the known apparatus is that the signal generated for low engine speeds is far too large for the prevailing requirements and results in high power losses in the ignition coil.

OBJECT AND SUMMARY OF THE INVENTION

It is thus a principal object of the invention to provide an electronic ignition control system which is capable of actuation by transducers having bipolar output signals, for example inductive transducers, as well as transducers having unipolar output signals, for example Hall-effect transducers. This and other objects are attained, according to the invention, by providing first and second threshold recognition circuits, and wherein the second threshold recognition circuit has a positive activation threshold and a positive de-activation threshold and wherein the output signal of the second threshold recognition circuit changes the negative threshold of the first threshold recognition circuit in the positive direction. The apparatus according to the invention further provides for the return of the second, negative threshold of the first recognition circuit into the negative region to be delayed by suitable time-delay circuitry.

The features of the invention make it possible to retain the technologically advantageous property of being able to shift the trigger threshold in the negative domain for use with bipolar transducer signals.

Another advantageous feature of the invention is the reduction of the length of the output signal beyond a given engine speed.

Still other advantages and objectives will emerge from the description of a preferred exemplary embodiment of the invention which is illustrated in the drawing.

FIG. 1 is a block circuit diagram of an examplary embodiment of the invention;

FIG. 2 is a diagram illustrating a number of transducer output signals;

FIG. 3 is a set of diagrams to illustrate the operation of the system under the control of an inductive transducer;

DESCRIPTION OF THE PREFERRED EMBODIMENT

Figure 4:
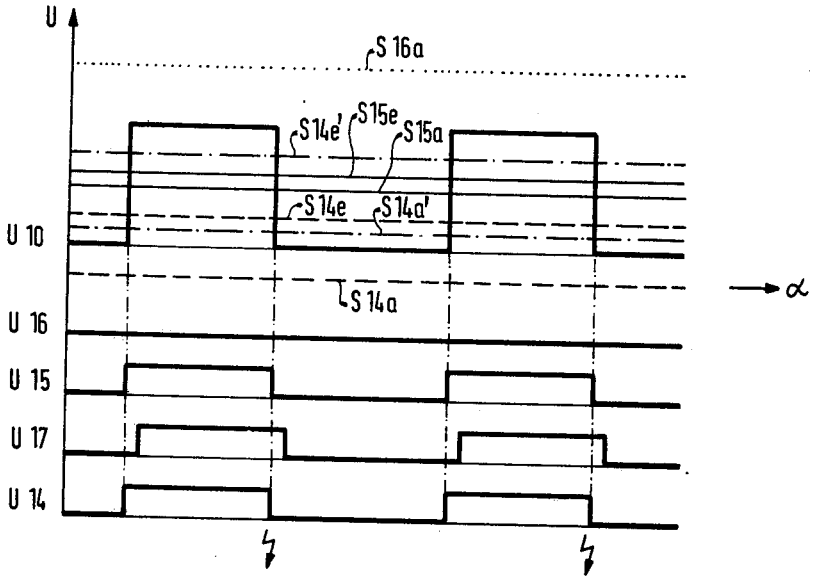
FIG. 4 is a set of diagrams illustrating the operation of the system actuated by a Hall-effect sensor.

The exemplary embodiment of the invention illustrated in schematic form in FIG. 1 includes a transducer assembly 10 having a rotary part 11 which, for use with an internal combustion engine, may be attached to and rotated by a, for example, crankshaft or the camshaft of the engine. The rotating member 11 has markers 12 whose passage is detected by a transducer or sensor 13. If the transducer is inductive, it generates a bipolar output signal such as illustrative as curve U10. If the transducer is a Hall-effect transducer it generates a unipolar output signal such as the signal U10 in FIG. 4.

The transducer output signal is coupled to the input of two non-inverting Schmitt triggers 14, 15 as well as to the input of an inverting Schmitt trigger 16. The output of the Schmitt trigger 15 is coupled over a time delay element 17, for example an RC member, to the input of an OR gate 18 whose output goes to the control input of the first Schmitt trigger 14 for the purpose of altering its trigger thresholds. The output of the inverting Schmitt trigger 16 is then coupled to another input of the OR gate 18.

The output of the first Schmitt trigger 14 is connected via a contact 19 to an electrical system 20 which is controlled by the output signal of the apparatus including elements 10–19. The system 20 may be, for example, the ignition system of an internal combustion engine.

However, it is also possible for that system to be some other electrical system requiring the type of input control afforded by the apparatus of the invention.

The problems arising in the operation of an ignition system are illustrated in FIG. 2. However, similar problems and situations can also occur when other systems 20 are used. The typical output signal of an inductive transducer is shown as curve A. The duration of this signal, i.e., the angle $\alpha$, is plotted as a function of engine speed n. However, the signal which is needed by an ignition system really corresponds more closely to the curve B, i.e., with increasing engine speed, the angle of the output signal must be continuously increased so as to maintain a constancy of the time of duration of the output control signal, i.e., the closure of the primary coil switch. In the system of the prior art, the output signal of an inductive sensor, i.e., the curve A, is used to generate a basic ignition closure angle which is then modified, i.e, increased with increasing engine speed, to obtain a corrected curve B. This may be done without difficulty beginning with some engine speed $n_0$. However, below this speed $n_0$, the curve A lies above the curve B so that the ignition closure time will be too high and the power losses too great. It is the characteristic feature of the present invention that the presence of the Schmitt trigger 16 in cooperation with the Schmitt trigger 14 generates an output curve C which eliminates a substantial portion of the undesired power loss as shown by the shaded region in FIG. 2.

The operation of the system illustrated in block diagram in FIG. 1 will now be explained with the aid of the timing diagrams and signals of FIG. 3. Assuming the transducer to be an inductive transducer generating a bipolar output signal as illustrated in FIG. 3 as curve U10, the engine speed dependency of this signal is illustrated by displaying an output signal for high engine speeds as well as an output signal for low engine speeds. High engine speeds are those lying above, for example, $n_0=500$ rpm. In the first cycle displayed, the engine speed lies below $n_0$, i.e., the dotted lines S16*a* and S16*e* which represent the thresholds of the Schmitt trigger 16 are never reached and thus the trigger 16 generates no output signal U16. However, the Schmitt trigger 14 switches over when the threshold A14*e* is crossed and is turned off when the lower threshold S14*a* is crossed by the input signal. Similarly, the Schmitt trigger 15 turns on when the threshold S15*e* is crossed and turns off when the threshold S15*a* is crossed, thereby generating the output signal U15. The signal U15 is delayed by a time v by means of the delay circuit 17, thereby generating the signal U17 which is fed through the OR gate 18 to the input of the Schmitt trigger 14 and, while present, changes the trigger thresholds of the Schmitt trigger 14 from the values S14*e* and S14*a* to the values S14*e'* and S14*a'*, respectively. These changed thresholds are illustrated by dash-dotted lines. However, the change of these thresholds in the trigger 14 does not affect the signal U14 of that cycle because when the threshold S14*e'* is engaged, the signal U14 has already been turned on and the signal U17 will have been turned off by the time either the threshold S14*a* or the threshold S14*a'* is reached.

In the second cycle illustrated in FIG. 3, the engine speed threshold $n_0$ is crossed, i.e., the transducer voltage U10 exceeds the thresholds of the trigger S16. The trigger 16 being an inverting Schmitt trigger, it is turned on by the crossing of the lower threshold S16*e* and is turned off by the crossing of the upper threshold S16*a*. In between these events, the trigger generates a signal U16 which is applied to the OR gate 18 and also causes the shift of the thresholds from the levels 14*e*, 41*a* to the levels 14*e'*, 14*a'*. This shift however has an effect on the onset of the signal U14 because the occurrence of the signal U16 makes the turnon threshold S14*e'* effective. However, the terminus of the signal U14 is not affected by either the signal U16, not the signal U17 because both of these signals have terminated before the transducer signal U10 reaches either of the thresholds S14*a* or S14*a'*. However, the higher input threshold does cause an abrupt shortening of the signal U14 if the transducer voltage U10 exceeds the thresholds S16*e* and S16*a*. Thus, if the transducer used with the system is an inductive transducer, the elements 15, 17 have no effect whatever on the signal U14 but the Schmitt trigger 16 shortens the signal U14 when the limiting engine speed $n_0$ is crossed.

When the input transducer 10 is a Hall-effect transducer, the operation of the system is somewhat different and is illustrated in FIG. 4. The discussion of FIG. 4 also relates to the use of any other unipolar transducer. Due to the delayed occurrence of the signal U17, the effective threshold of the trigger U14 is the level S14*e*. However, this fact has no particular significance because the threshold S14*e'* is exceeded virtually at the same time. The signal U14 can never be terminated by the downward crossing of the threshold S14*a* because the tranducer signal never assumes negative values. However, the effect of the time delay v is that when the rear edge of the signal U10 occurs, the signal U17 is still present and engages the threshold value S14*a'* as a turn-off level. Accordingly, the rear edges of the signal U14 and the signal U10 coincide. If the speed $n_0$ is exceeded, there is no effect at all because the turn-on threshold S16*e* of the Schmitt trigger 16 is negative and is never reached by the signal U10. Furthermore the amplitude of the Hall-effect output signal is not rpm-dependent so the turn-off threshold S16*a* is never reached either.

Figure 5:
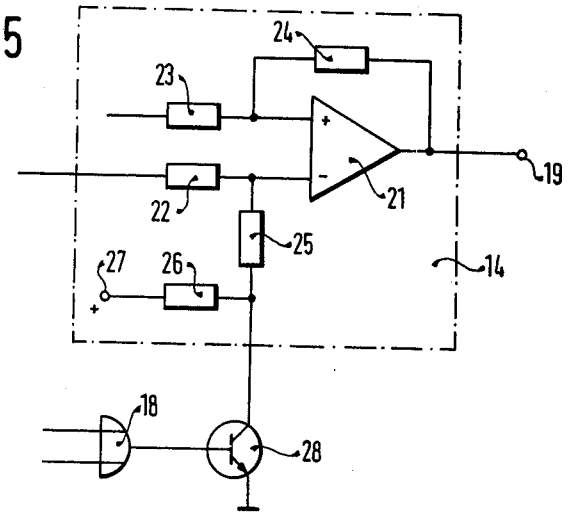
FIG. 5 is a circuit diagram of one possible embodiment of a threshold switch used in the system of FIG. 1.

An exemplary embodiment of a Schmitt trigger which may be used for example as the Schmitt trigger 14 is illustrated in FIG. 5. It includes an operational amplifier 21 whose output is applied to the circuit point 19. Its inverting input is connected via a resistor 22 to the output of the transducer assembly 10. The non-inverting input of the operational amplfier 21 receives a reference voltage through a resistor 23. A feedback resistor 24 couples the output of the amplifier 21 to its non-inverting input. The inverting input of the amplifier 21 is further connected through a voltage divider 25, 26 to a source of positive potential 27. The junction of the resistors 25, 26 is connected to ground through the collector-emitter path of a transistor 28 whose base is connected to the output of the aforementioned OR gate 18. The turn-on and turn-off thresholds of this trigger are defined by the ratio of resistors 23, 24. However, if the transistors 28 becomes conducting due to the presence of a signal from either trigger 17 or trigger 16, the current flowing through the resistor 25 is compensated by a correspondingly higher current through the resistor 22 so that the transducer voltage must be correspondingly higher to have an effect. If the transistor 28 is blocked, the current flowing through the resistors R25, R26 compensates the current flowing to ground through the resistor 22 and the transducer. The threshold levels are thus shifted to the negative domain.

The foregoing relates to a preferred exemplary embodiment of the invention, it being understood that other embodiments and variants thereof are possible within the spirit and scope of the invention.

We claim:

1. An apparatus for generating control signals based on the output signal from a rotary transducer, especially for controlling the ignition system of an internal combustion engine, said apparatus including a transducer (10) having a rotary portion for generating an output signal which is at least dependent on angle of rotation and further including a principal threshold switch (14) having a first, positive threshold which, when exceeded by said transducer signal, causes said primary threshold switch to assume a first state and having a second, negative threshold which, when crossed by said transducer signal, causes said primary threshold switch to assume a second state, and wherein, according to the invention, said apparatus comprises a second threshold switch (15) having a positive activation threshold and a positive de-activation threshold, the output signal from said second threshold switch (15) being applied to said first threshold switch (14) to thereby shift the second, negative threshold thereof to a more positive electrical value and said apparatus further comprises a delay member (17) for delaying the return of said second negative threshold to more negative values.

2. An apparatus according to claim 1, further comprising means (16) for reducing the relative angle during which said control signals occur beyond a given engine speed.

3. An apparatus according to claims 1 or 2, wherein said means (16) are a third threshold switch (16) having activation and de-activation thresholds set so high as to be reachable by said transducer signal only at the higher engine speeds than those of the other threshold switches (14, 15), and the output signal of said third threshold switch (16) being applied to said threshold switch (14) to thereby shift at least the positive threshold thereof to more positive values.

4. An apparatus according to claim 3, wherein the output signal from said second threshold switch (15) and the output signal from said third threshold switch (16) are connected to said first threshold switch (14) to cause identical changes in the thresholds thereof.

5. An apparatus according to claim 1, wherein at least said first threshold switch (14) is a Schmitt trigger.

6. An apparatus according to claim 5, wherein said Schmitt trigger includes an operational amplifier (21) whose effective activation and de-activation thresholds are shifted by changing the current flow at an input of said amplifier (21).

7. An apparatus according to claim 6, wherein said Schmitt trigger includes a semiconductor switch (28) whose action is controlld by the output signal of said second threshold switch (15) and/or of said third threshold switch (16), the semiconductor switch (28) controlling the current flow through a voltage divider connected to an input of said operational amplifier (21).

* * * * *